US007391380B2

(12) United States Patent
Nevermann

(10) Patent No.: US 7,391,380 B2
(45) Date of Patent: Jun. 24, 2008

(54) TELECOMMUNICATION ANTENNA

(75) Inventor: Peter Nevermann, Langenfeld (DE)

(73) Assignee: Lumberg Connect GmbH & Co. KG, Schalksmuhle (DE)

( * ) Notice: Subject to any disclaimer, the term of this patent is extended or adjusted under 35 U.S.C. 154(b) by 0 days.

(21) Appl. No.: 11/655,045

(22) Filed: Jan. 18, 2007

(65) Prior Publication Data

US 2007/0164915 A1 Jul. 19, 2007

(30) Foreign Application Priority Data

Jan. 19, 2006 (DE) ..... 10 2006 002 817

(51) Int. Cl.
*H01Q 1/24* (2006.01)

(52) U.S. Cl. ..... 343/702; 343/700 MS; 343/745; 342/361

(58) Field of Classification Search ..... 342/361, 342/368; 455/295; 343/745, 700 MS, 702, 343/829, 846
See application file for complete search history.

(56) References Cited

U.S. PATENT DOCUMENTS 5,182,568 A * 1/1993 Stamps et al. ..... 343/702
6,680,703 B1 1/2004 McConnell
6,703,974 B2 * 3/2004 White et al. ..... 342/361
7,120,399 B2 * 10/2006 Khorram ..... 455/121
7,132,989 B1 * 11/2006 Poilasne ..... 343/745
7,265,724 B1 * 9/2007 Tan et al. ..... 343/702

FOREIGN PATENT DOCUMENTS

DE 101 10 982 9/2002

* cited by examiner

*Primary Examiner*—Tho G Phan
(74) *Attorney, Agent, or Firm*—Andrew Wilford

(57) ABSTRACT

A telecommunication device has a permanently mounted antenna tuned to a predetermined resonant frequency and a housing formed of a plurality of parts one of which is removable. The one removable part, which may be an original element or an aftermarket add-on, changes the resonant frequency of the antenna when fitted to the housing. An electrically conductive passive correction element fixed in the one removable housing part is positioned therein and dimensioned such that when the one removable housing part is fitted to the housing the passive correction element cancels out the effect on the resonant frequency of the antenna by the one removable housing part.

17 Claims, 3 Drawing Sheets

TELECOMMUNICATION ANTENNA

FIELD OF THE INVENTION

The present invention relates to an antenna. More particularly this invention concerns a telecommunication antenna for a cell phone, portable computer, walkie-talkie, or the like for sending and receiving radio signals.

BACKGROUND OF THE INVENTION

A mobile telecommunication device such as a cellular telephone, portable computer, or radio handset, has at least one radiator formed by an electrical conductor for transmitting and receiving communications data and having a resonant frequency that is tuned to a specific band. Such a radiator is mounted at least partially inside a housing together with at least one other housing part for the communications device.

Such antennas are known from the prior art and are constituted for example as rod antennas, helical antennas, or monopole or dipole antennas, as well as PIFA's (planar inverted f-antennas) in various telecommunication devices. Modern telecommunication devices, whether cell phones, portable computers such as notebooks or PDA's (personal digital assistants), radio handsets, or the like, are being designed in increasingly smaller sizes to enhance the convenience of such devices. At the same time, such telecommunication devices incorporate a continuously increasing number of functions.

In particular cell phones now serve many different functions. They may now be used to take photographs, play music, receive e-mail, access internet services, etc. The integration of more and more functions with the simultaneous miniaturization of the devices imposes high demands on the individual components, in particular their size.

Among other components, the antennas of such devices have increasingly become the object of specific improvements, in particular structural miniaturization. However, this must be balanced with the requirement for the best possible transmitting and receiving power, also in multiple frequency bands.

A further problem for antennas for telecommunication devices is the alteration of the antenna's characteristics by the device's housing. Depending on a number of factors, such as material and color, for example, a shift occurs in the resonant frequency of the radiator for the antenna, thereby affecting its transmitting and receiving power. Furthermore, in particular for cell phones, numerous exchangeable housing parts such as face plates, back shells, or battery covers are offered to customize the design of the device. In addition to various colors, frequently created using metallized paints or metal-filled plastics that affect an antenna's tuned frequency, there are also housing parts made of a variety of materials, such as of plastic with additional leather or fabric applications.

A method not documented in the published prior art for providing an antenna that tolerates such variable circumstances consists in the use of antennas having a large bandwidth and consequently a larger size. However, this conflicts with the above-mentioned requirements for increasingly smaller components, in addition to smaller antennas.

It is also known from U.S. Pat. No. 6,680,703 to provide a system of several varactors to allow tuning of a narrow-band antenna. Such a system does indeed allow a technician to fix a detuned antenna, but is not readily applicable, and is fairly expensive because of the active circuit elements used, that is the varactor diodes. It is not usable, for instance, in a cheap replacement back shell that is going to be installed by a technically unsophisticated user, and that might be purchased solely to give the electronic device in question a certain decor.

OBJECTS OF THE INVENTION

It is therefore an object of the present invention to provide an improved system for upgrading a housing of an electronic device without deleteriously affecting the tune of its antenna.

Another object is the provision of such an improved system for upgrading a housing of an electronic device without deleteriously affecting the tune of its antenna that overcomes the above-given disadvantages, in particular that allows, for instance, a cell-phone back shell to be replaced with another of different design, e.g. material, without detuning the phone's antenna.

SUMMARY OF THE INVENTION

The instant invention relates to a telecommunication device having a permanently mounted antenna tuned to a predetermined resonant frequency and a housing formed of a plurality of parts one of which is removable. The one removable part, which may be an original element or an aftermarket add-on, changes the resonant frequency of the antenna when fitted to the housing. According to the invention an electrically conductive passive correction element fixed in the one removable housing part is positioned therein and dimensioned such that when the one removable housing part is fitted to the housing the passive correction element cancels out the effect on the resonant frequency of the antenna by the one removable housing part.

The obvious advantage of the antenna according to the invention is that this antenna need be optimized only for the transmitting and receiving power in the corresponding frequency band, without having to take into account the effects on the resonant frequency of the radiator caused by the removable housing part. The shift in the resonant frequency of the antenna's radiator caused by the housing part is compensated for by the passive correction element provided on the housing part. It is thus possible to provide a universal, compact antenna for various telecommunication devices in which the adaptation to the particular telecommunication device or housing thereof is performed by the passive correction element. Provision of the passive correction element, which can be a simple and cheap part as compared to an active element such as a varactor, makes the invention particularly advantageous.

It is known from unrelated prior art, namely, Siemens Technology Report, Vol. 4, No. 13/2001, page 121, to change a radiator of an antenna provided for a specific frequency band. Thus, for a cell phone that transmits and receives in the 1800 MHz band, for example, this radiator may be exchanged for a radiator for the 1900 MHz band. It is also known from the cited publication to replace the entire antenna comprising multiple radiators. In this case, however, no correction of the resonant frequency is performed, and instead, transmitting and receiving by means of one resonant frequency in favor of another resonant frequency is omitted.

A correction element is known from DE 101 10 982 that corrects the SAR value of an antenna. The SAR value indicates the portion of the antenna power that is absorbed by the human body. The purpose of this correction element is to allocate in a targeted manner any electrical current flowing on the printed circuit board, from one more of the local current maxima to the correction element, so that when the cell phone is in use the local distribution of the overall resulting electrical current on the printed circuit board and the auxiliary element, viewed as a whole, is equalized, thereby displacing the original current maxima to a region of the device that is not critical for the user.

However, such correction elements do not take the resonant frequency of the antenna, in particular of the radiator(s), into account.

A further embodiment of the invention is characterized in that for a multiband antenna, the antenna for transmitting and receiving communications data in multiple frequency bands forms a radiator for each frequency band with a correspondingly adapted resonant frequency, at least one radiator being situated at least partially inside the housing part, and at least one correction element provided on the housing part compensating for the influences of this housing part on the resonant frequency of at least one radiator, thereby allowing the previously mentioned advantages to be realized for multiband antennas as well.

In one particularly preferred embodiment, the one radiator for a housing comprising multiple housing parts is situated at least partially inside a first housing part, and the resonant frequency of the radiator is adapted to this housing part, and the correction element is provided on another housing part and compensates for the influences of the other housing part on the resonant frequency of the at least one radiator.

Such an antenna is particularly suited for cell phones that are designed from the outset for customization using additional exchangeable housing parts, in particular back shells and/or battery covers. Adaptation of the resonant frequency of the antenna typically takes place on the permanent housing part, e.g. normally the front housing part holding the circuit board itself carrying the display, keypad, and battery connection. Provided that the housing parts, among others, offered also by third-party manufacturers advantageously have a correction element, a variety of materials may be used for manufacturing the replacement removable housing part without concern for the negative influences on the transmitting and receiving power of the radiator of the antenna for the cell phone.

Depending on the type of housing part, the passive correction element provided on the housing part may be designed as a parasitic correction element, and may be capacitively and/or inductively coupled to the radiator. Alternatively, the passive correction element may be galvanically connected to the radiator.

When the radiator and correction element are galvanically connected to one another, the galvanic connection is advantageously provided in a simple manner by at least one spring contact. This spring contact may be a unitary part of the correction element situated on the removable housing part, or of the radiator situated inside the permanent housing part.

For a multiband antenna having multiple radiators, each of which has a resonant frequency that is adapted to a specific frequency band, a single passive correction element provided on the housing part is able to compensate for the influences of the housing part on the respective resonant frequencies of one or more radiators.

Alternatively, each radiator may be associated with a respective correction element that is provided on the removable housing part and that compensates for the influences of the removable housing part on the resonant frequency of the permanently mounted antenna.

Lastly, multiple correction elements may also be provided on the removable housing part that compensate for the influences of the housing part on the resonant frequencies of multiple radiators on the permanent part.

In one further advantageous embodiment, the passive correction element is integrated in the removable housing part in order to make optimal use of the space within the housing.

The passive correction elements are preferably designed as a stamped part from a metal sheet or a foil.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 4:
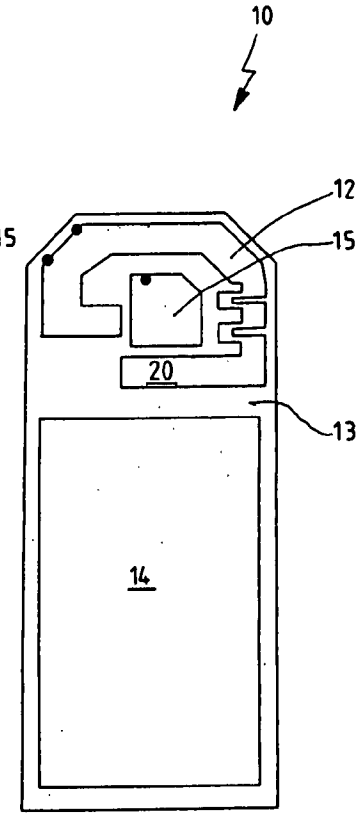
Fig. 4 PRIOR ART
FIGS. 3 and 4 are views like respective FIGS. 1 and 2 of another prior-art cell phone.

In the following description and in the drawing, the invention is shown with reference to a cell phone. However, it is understood as a matter of course that the invention is not limited to cell phones as such; rather, the invention may find application for any telecommunication device having an antenna situated at least partially inside a housing.

In the drawing reference numeral 10 indicates a cell phone as a whole. This cell phone 10 comprises a rear housing part that is also referred to as a back shell 11, at least one radiator 12 for an antenna for transmitting and receiving communication signals, and a printed circuit board 13 having a rear face turned toward the shell 11 and carrying unillustrated circuit elements and a front face turned away from the shell and carrying the standard display and keypad. The board 13 and back shell 11 form a housing 23. A schematically shown battery module is shown 14. As is customary for most cell phones 10, the radiator 12 for the antenna is part of a PIFA.

Figure 3:
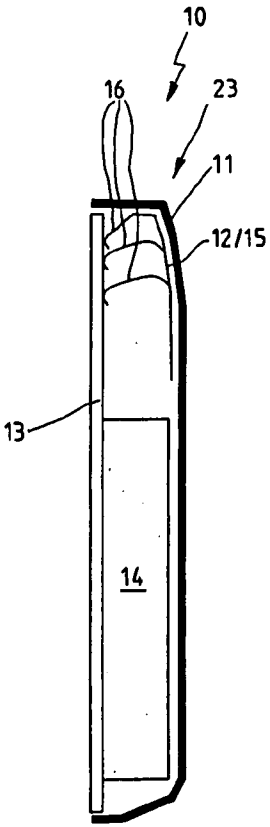
Fig. 3 PRIOR ART
Figure 2:
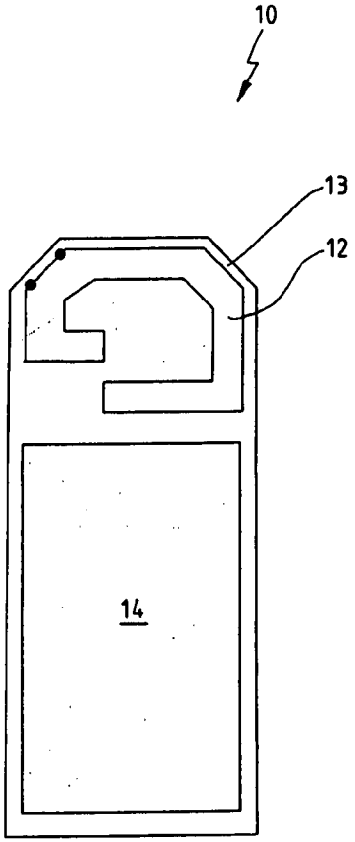
Fig. 2 PRIOR ART
FIG. 2 is a rear view of the FIG. 1 prior-art phone with the rear shell removed for clarity of view.
Figure 1:
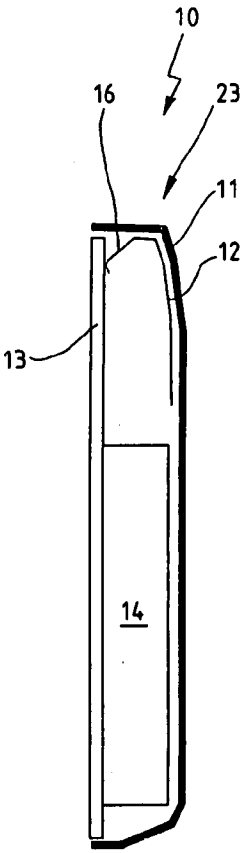
Fig. 1 PRIOR ART
FIG. 1 is vertical section through a prior-art cell phone with an antenna.

FIGS. 1 and 2 show an antenna whose radiator 12 transmits and receives communications data in two frequency bands. In contrast, FIGS. 3 and 4 show a prior-art cell phone having a multiband antenna with an additional parasitic radiator 15. This radiator 15 is electromagnetically excited by the radiator 12 and is used for transmitting and receiving communications signals in an additional frequency band. The radiators 12 and 15 are connected to a HF source on the printed circuit board 13 via contacts 16.

FIG. 5 shows once again a housing part according to the invention, namely, a replacement back shell 17. This replacement back shell 17 may also be a battery cover. The replacement back shell 17 has passive correction elements 18. These correction elements 18 are preferably designed as parts stamped from a metal sheet or foil, for example, and have spring contacts 19 for galvanic connection to the radiator 12 of the cell phone 10. The spring contacts 19 are designed as integral parts of the correction elements 18, and have an elastic pretension directed toward the radiator 12.

Figure 6:
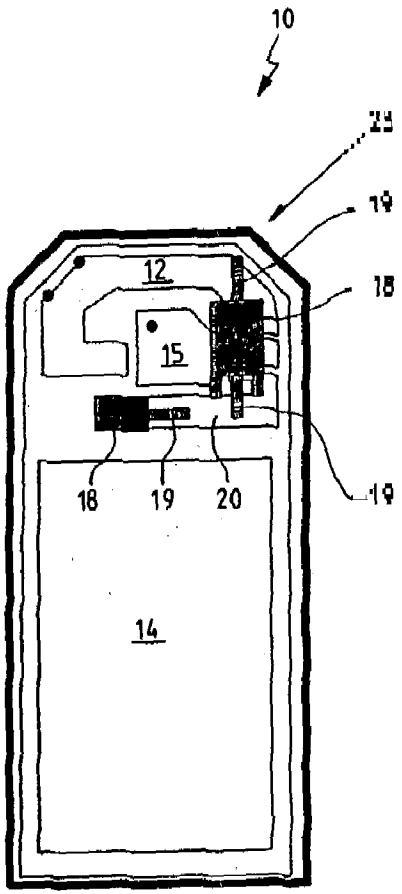
FIGS. 6 and 7 are views like respective FIGS. 1 and 2 of a cell phone with the rear shell of FIG. 5.
Figure 7:
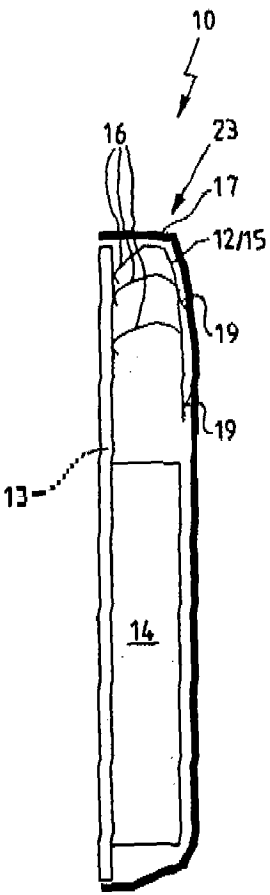

In FIGS. 6 and 7 the housing part 17 according to the invention is fitted to a cell phone 10 according to FIGS. 3 and 4. In the sectional side view of FIG. 7, the galvanic contact of the passive correction elements 18 to the radiator 12 via the spring contacts 19 is easily seen, only the spring contacts 19 for the perpendicularly aligned correction element 18 being shown.

Figure 5:
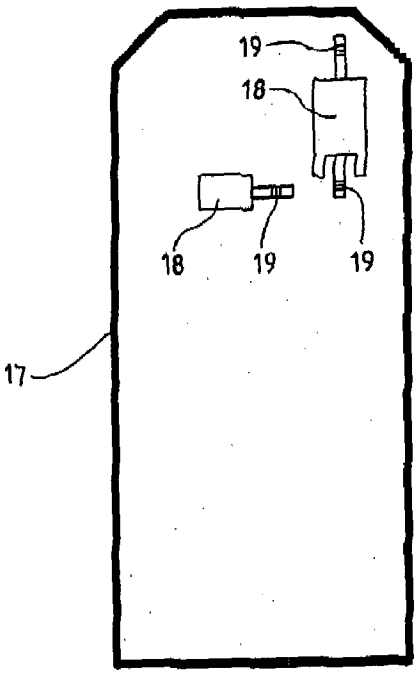
FIG. 5 is a front view of a rear shell according to the invention.

FIG. 6 is a rear view of the cell phone 10 with a mounted replacement back shell 17 according to FIG. 5. The rear part of the back shell 17 is cut away in the plane of the drawing to reveal the interior of the cell phone 10.

The effect of the replacement back shell 17 of the cell phone 10 on the resonant frequency of the radiators 12 and 15 may be compensated for by means of the correction elements 18. In the illustration of FIG. 4 it can be seen that the horizontally aligned correction element 18 is an extension of an arm 20 of the radiator 12. In contrast, the vertically aligned correction element 18 bridges the vertically aligned, meandering region of the radiator 12, clearly visible in FIG. 4, thereby shortening the radiator 12 in this region.

The passive correction elements 18 may be designed in such a way that they likewise influence the resonant frequency of the parasitic radiator 15. For this purpose (not shown here), a galvanic connection between at least one correction element 18 and the parasitic radiator 15, or also an inductive and/or capacitive coupling of one or both correction elements 18 to the parasitic radiator 15, is possible. The elements 18 thus form parasitic correction elements 18 with respect to the parasitic radiator 15.

FIGS. 8 and 9 show once again a cell phone 10 having a replacement back shell 17 according to the invention. In this embodiment, the correction elements 21 are parasitic correction elements 21 that are coupled inductively and/or capacitively, not galvanically, to the radiator 12 in order to compensate for the influences of the replacement back shell on the resonant frequency of the radiator 12.

Figure 10:
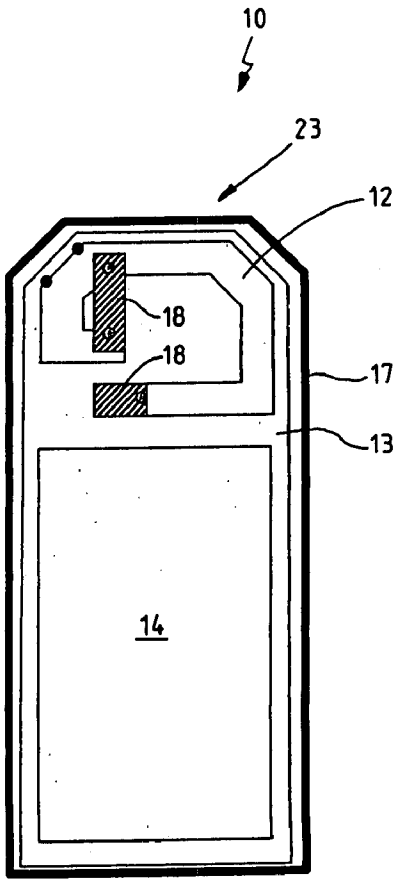
FIGS. 10 and 11 are views like respective FIGS. 1 and 2 of the third embodiment of the invention.
Figure 11:
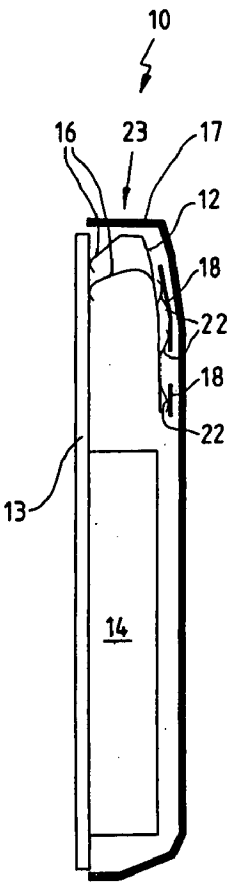
Figure 8:
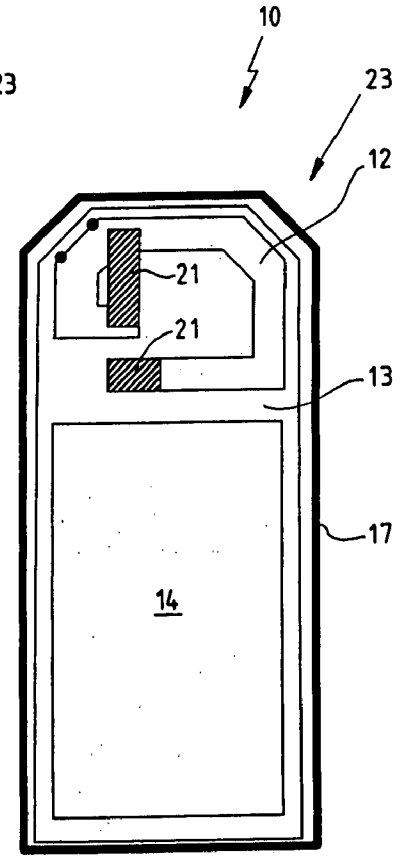
FIGS. 8 and 9 are views like respective FIGS. 1 and 2 of the second embodiment of the invention.
Figure 9:
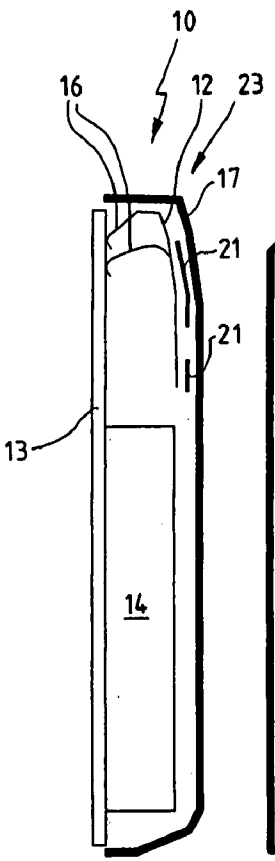

Finally, FIGS. 10 and 11 show once again a cell phone 10 having a replacement back shell 17 according to the invention, according to FIGS. 8 and 9. In contrast to the illustration of FIGS. 8 and 9, there is a galvanic connection between the correction elements 18 and the radiator 12. However, this is achieved by means of spring contacts 22 that are formed by the radiator 12. With reference to a comparable illustration in FIGS. 9 and 11, it is clear that a replacement back shell 17 having passive correction elements 18 or 21 may provide correction elements 18 for a galvanic coupling, or may provide parasitic correction elements 21 of identical design, depending on whether the radiator 12 is furnished with spring contacts 22.

In summary, the invention relates to an antenna for transmitting and receiving communications data in one or more frequency bands, which functions without special adaptation to the housing or to specific housing parts. Adaptation to the housing or to the housing parts is performed by passive correction elements provided on the corresponding housing or housing part, so that compensation is made for the influences of the housing or housing parts on the resonant frequency of the antenna. Thus, an antenna is described that is optimized for its transmitting and receiving power and has small space requirements, and whose housing-specific adaptation is performed by means of correction elements.

I claim:

1. In a telecommunication device having an antenna tuned to a predetermined resonant frequency and a housing formed of a plurality of parts, one of the parts changing the resonant frequency of the antenna, the improvement comprising an electrically conductive passive correction element fixed in the one housing part and positioned therein and dimensioned such that the passive correction element cancels out the effect on the resonant frequency of the antenna by the one housing part.

2. The improvement defined in claim 1 wherein the antenna has a plurality of radiators each tuned to a respective resonant frequency, the one part carrying respective such passive correction elements each positioned and dimensioned to cancel out the effect on the resonant frequency of the respective radiator by the one housing part.

3. The improvement defined in claim 1 wherein the passive correction element is a thin metal sheet fixed in the one housing part.

4. The improvement defined in claim 3 wherein the passive correction element is out of direct galvanic contact with the antenna and operates parasitically.

5. The improvement defined in claim 3, further comprising a spring contact engaged galvanically between the antenna and the passive correction element.

6. The improvement defined in claim 5 wherein the spring contact is unitarily formed with the passive correction element.

7. The improvement defined in claim 5 wherein the spring contact is fixed on the antenna.

8. The improvement defined in claim 1 wherein the antenna has a plurality of radiators and the passive correction element is juxtaposed with all of them.

9. The improvement defined in claim 1 wherein the antenna is permanently mounted in the housing and the one part is removable from the housing.

10. In a telecommunication device having a permanently mounted antenna tuned to a predetermined resonant frequency and a housing formed of a plurality of parts one of which is removable, the one removable part changing the resonant frequency of the antenna when fitted to the housing, the improvement comprising an electrically conductive passive correction element fixed in the one removable housing part and positioned therein and dimensioned such that when the one removable housing part is fitted to the housing the passive correction element cancels out the effect on the resonant frequency of the antenna by the one removable housing part.

11. The improvement defined in claim 10 wherein the permanently mounted antenna has a plurality of radiators each tuned to a respective resonant frequency, the removable part carrying respective such passive correction elements each positioned and dimensioned to cancel out the effect on the resonant frequency of the respective radiator by the one removable housing part.

12. The improvement defined in claim 10 wherein the passive correction element is a thin metal sheet fixed in the removable housing part.

13. The improvement defined in claim 12 wherein the passive correction element is out of direct galvanic contact with the antenna and operates parasitically.

14. The improvement defined in claim 12, further comprising a spring contact engaged galvanically between the antenna and the passive correction element.

15. The improvement defined in claim 14 wherein the spring contact is unitarily formed with the passive correction element.

16. The improvement defined in claim 14 wherein the spring contact is fixed on the antenna.

17. The improvement defined in claim 10 wherein the antenna has a plurality of radiators and the passive correction element is juxtaposed with all of them when the removable housing part is fitted to the housing.

* * * * *